US005393468A

United States Patent [19]

Erilli et al.

[11] Patent Number: 5,393,468

[45] Date of Patent: Feb. 28, 1995

[54] HARD SURFACE CLEANER

[75] Inventors: Rita Erilli, Liege; Regis Lysy, Olne; Patrick Durbut, Verviers; Guy Broze, Grace-Hollogne, all of Belgium

[73] Assignee: Colgate Palmolive Company, Piscataway, N.J.

[21] Appl. No.: 91,775

[22] Filed: Jul. 14, 1993

[51] Int. Cl.[6] ..... C11D 3/065

[52] U.S. Cl. ..... 252/550; 252/162; 252/170; 252/173; 252/552; 252/554; 252/553

[58] Field of Search ..... 252/122, 174.1, 170, 252/171, 162, 546, 552, 550, 554, 553

[56] References Cited

U.S. PATENT DOCUMENTS

| | | | |
|---|---|---|---|
| 4,749,516 | 6/1988 | Brusky et al. | 252/546 |
| 5,075,026 | 12/1991 | Loth et al. | 252/122 |
| 5,076,954 | 12/1991 | Loth et al. | 252/122 |
| 5,082,584 | 1/1992 | Loth et al. | 252/122 |
| 5,108,643 | 4/1992 | Loth et al. | 252/174.11 |

*Primary Examiner*—Paul Lieberman
*Assistant Examiner*—Necholus Ogden
*Attorney, Agent, or Firm*—Richard E. Nanfeldt; Robert C. Sullivan; Murray Grill

[57] ABSTRACT

A composition comprising approximately by weight 6 to 50% of a mixture of two different anionic surfactants, one of said anionic surfactants being a sulphonate and the other said anionic surfactant being a sulphate, a ratio of said sulphonate to said sulphate being 10:1 to 1:10; 0 to 6% of a nonionic surfactant; 1 to 20% of at least one of a water insoluble organic compound; 0 to 8% of a solubilizing agent; 0 to 14% of at least one water soluble hydroxy containing organic compound; and the balance being water, wherein the composition has a pH of about 1 to about 11 and is optically clear having at least 90% light transmission and the interfacial tension between the lipophile droplets of said composition and the aqueous phase less than about $10^{-2}$ m N/m.

14 Claims, No Drawings

HARD SURFACE CLEANER

FIELD OF THE INVENTION

This invention relates to a stable microemulsion cleaning composition and to processes for manufacture and use thereof. More particularly, it relates to a stable aqueous microemulsion cleaning composition in concentrated or diluted form which is especially effective to clean oily and greasy soils from substrates such as bathroom fixtures and walls, leaving such surfaces clean and shiny without the need for extensive rinsing thereof. The described compositions comprise a mixture of anionic surfactants, a water insoluble organic compound has less than 1.0 wt. % soluble in water at 25 degrees C. and having an $\delta_H$ of about 0 to about 12 (MPa) $\frac{1}{2}$ to about 14, $\delta_d$ of about 19 (MPa) $\frac{1}{2}$, and $\delta_H$ of about 0 to about 6 (MPa) $\frac{1}{2}$, water and a suitable co-surfactant system, which cosurfactant system adjusts the interface conformation to reduce interfacial tension at interfaces between dispersed and continuous phases of the emulsion to produce a stable normally clear microemulsion at room temperature. When the pH of the microemulsion is on the acid side, preferably in the range of 1 to 4, the invented compositions are useful for removing lime scale and soap scum from hard substrates.

BACKGROUND OF THE INVENTION

Liquid detergent compositions, usually in solution or emulsion form, have been employed as all-purpose detergents and have been suggested for cleaning hard surfaces such as painted woodwork, bathtubs, sinks, tile floors, tiled walls, linoleum, paneling and washable wallpaper. Many such preparations, such as those described in U.S. Pat. Nos. 2,560,839, 3,234,138, and 3,350,319 and British Patent Specification No. 1223739, include substantial proportions of inorganic phosphate builder salts, the presence of which can sometimes be found objectionable for environmental reasons and also because they necessitate thorough rinsing of the liquid detergent from the cleaned surface to avoid the presence of noticeable depositings of phosphate thereon. In U.S. Pat. Nos. 4,017,409 and 4,244,840 liquid detergents of reduced phosphate builder salt contents have been described but such may still require rinsing or can include enough phosphate to be environmentally objectionable. Some liquid detergents have been made which are phosphate-free, such as those described in U.S. Pat. No. 3,935,130, but these normally include higher percentages of synthetic organic detergent which increased detergent content may be objectionable due to excessive foaming during use that can result from its presence. The previously described liquid detergent compositions are emulsions but are not disclosed to be microemulsions like those of the present invention.

Microemulsions have been disclosed in various patents and patent applications for liquid detergent compositions which may be useful as hard surface cleaners or all-purpose cleaners, and such compositions have sometimes included detergent, solvent, water and a co-surfactant. Among such disclosures are European Patent Specification Nos. 0137615, 0137616, and 0160762, and U.S. Pat. No. 4,561,448, all of which describe employing at least 5% by weight of the solvent in the compositions. The use of magnesium salts to improve grease removing performance of solvents in microemulsion liquid detergent compositions is mentioned in British Patent Specification No. 2144763. Other patents on liquid detergent cleaning compositions in microemulsion form are U.S. Pat. Nos. 3,723,330, 4,472,291, and 4,540,448. Additional formulas of liquid detergent compositions in emulsion form which include hydrocarbons, such as terpenes, are disclosed in British Patent Specifications Nos. 1603047 and 2033421, European Specification No. 0080749, and U.S. Pat. Nos. 4,017,409, 4,414,128, and 4,540,505. However, the presence of builder salt in such compositions, especially in the presence of magnesium compounds, tends to destabilize the microemulsions and therefore such builders are considered to be undesirable.

Although the cited prior art relates to liquid all-purpose detergent compositions in emulsion form and although various components of the present compositions are mentioned in the art, it is considered that the art does not anticipate or make obvious subject matter disclosed and claimed herein. In accordance with the present invention a stable aqueous microemulsion cleaning composition, which may be in concentrated or dilute form, comprises at least two different anionic synthetic organic detergent, a water insoluble organic compound, water and a co-surfactant system, which co-surfactant system adjusts interfacial conformation to reduce interfacial tension at interfaces between dispersed and continuous phases of an emulsion to produce a stable concentrated microemulsion which is stable at temperatures in the range of 5° to 50° C. and which has a pH in the range of 1 to 11. Such concentrated microemulsions are dilutable with water to at least five times their weight, to produce diluted liquid detergent compositions which are often also stable aqueous microemulsions which are useful as all-purpose cleaning compositions. Both the concentrated and diluted compositions are effective for cleaning oily and greasy soils from substrates, and when the compositions are acidic they are also useful to remove lime scale and soap scum from hard surfaces, such as bathroom fixtures, floors and walls.

In addition to microemulsion concentrates, the present invention also relates to dilute microemulsions to processes for manufacturing such microemulsions and to processes for cleaning surfaces with them.

SUMMARY OF THE INVENTION

The present invention provides an improved liquid cleaning composition in the form of a microemulsion which is suitable for cleaning hard surfaces having greasy build-up deposited thereon, such as plastic, vitreous and metal surfaces, all of which may have shiny finishes. While the all-purpose cleaning composition may also be used in other cleaning applications, such as removing oily soils and stains from fabrics, it is primarily intended for cleaning hard, shiny surfaces, and desirably requires little or no rinsing. The improved cleaning compositions of the invention exhibit superior grease removal actions, especially when used in concentrated form, and leave the cleaned surfaces shiny, sometimes without any need for rinsing them. Little or no residue will be seen on the cleaned surfaces, which overcomes one of the significant disadvantages of various prior art products, and the surfaces will shine, even after little or no wiping thereof. Surprisingly, this desirable cleaning is accomplished even in the absence of polyphosphates or other inorganic or organic detergent builder salts.

GENERAL DESCRIPTION OF THE INVENTION

In one aspect of the invention, a stable, clear, all-purposed hard surface cleaning composition which is especially effective in the removal of oily and greasy soils from hard surfaces, is in the form of a substantially concentrated or somewhat diluted microemulsion.

The compositions of the instant invention which are preferably microemulsions especially designed for superior removal of grease deposits on hard surfaces comprise approximately by weight:

a) 6 to 50% of a mixture of two different anionic surfactants, one of said anionic surfactants being a sulphonate and the other said anionic surfactant being a sulphate, a ratio of the sulphonate to the sulphate being about 10:1 to about 1:10, more preferably about 4:1 to about 2:1 and most preferably about 3.3:1 to about 2:7;

b ) 0 to 6% of a nonionic surfactant;

c) 1 to 20% of at least water insoluble organic compound having a $\delta_H$ of about 0 to about 12 $(MPa)^{\frac{1}{2}}$, a $\delta_d$ of about 14 to about 19 $(MPa)^{\frac{1}{2}}$, and a $\delta_p$ of about 0 to about 6 $(MPa)^{\frac{1}{2}}$;

d) 0 to 8% of a solubilizing agent;

e) 0 to 14% of at least one water soluble hydroxy containing organic compound which is a co-surfactant; and f) the balance being water, wherein the composition has a pH of about 1 to about 11, more preferably about 5 to about 9 and is optically clear having at least 90% light transmission, more preferably at least 95% and the interfacial tension between the lipophile droplets and the aqueous phase is less than about $10^{-2}$ mN/m, more preferably less than about $10^{-3}$ mN/m.

Preferred concentrations of the mentioned components of the concentrated microemulsion are 6 to 50 wt % of synthetic organic detergent, 1 to 20 wt % the water insoluble inorganic compound, 1 to 14 wt % of co-surfactant system, and the balance being water. At such preferred concentrations, upon dilution of one part of concentrate with four parts of water the resulting microemulsion will be low in detergent and solvent contents, which may be desirable to avoid excessive foaming and to prevent destabilization of the emulsion due to too great a content of lipophilic phase therein after dissolving in the suitable hydrocarbon or other solvent of the oily or greasy soil to be removed from a substrate to be cleaned. Because of the absence of builders when the cleaning composition consists of or consists essentially of the described components (with minor proportions of compatible adjuvants being permissible), a chalky appearance of the clean surface is avoided and rinsing may be obviated. Among the desirable adjuvants that may be present in the microemulsions are divalent or polyvalent metal salts, as sources of magnesium and aluminum, for example, which improve cleaning performances of the dilute compositions, and higher fatty acids and/or higher fatty acid soaps, such as sodium stearate at a concentration of about 1.0 to 5.0 wt. percent which act as foam suppressants as well as preserving the clarity of the product. Of course, if it is considered aesthetically desirable for the normally clear microemulsions to be cloudy or pearlescent in appearance, an opacifying or pearlescing agent may be present and in some instances, when it is not considered disadvantageous to have to rinse the builder off the substrate, builder salts, such as polyphosphates, may be present in the microemulsions, but it should be stressed that normally builders will be absent from them.

Some preferred "dilute" microemulsion cleaning compositions of this invention are those which are of formulas such as are producible by mixing four parts by weight of water with one part by weight of the concentrated microemulsion previously described. When other dilutions are employed, from 1:1 to 1:19 of concentrated microemulsion:water, the percentages of such ranges and preferred ranges should be adjusted accordingly. In some instances dilutions to 1:99 are feasible and such diluted compositions may be used as is or may be further diluted in some applications, as when employed for hand dishwashing (with rinsing).

Although most of the microemulsions of this invention are of the oil- in-water (o/w) type, some may be water-in-oil (w/o), especially the concentrates. Such may change to o/w on dilution with water, but both the o/w and w/o microemulsions are stable. However, the preferred detergent compositions are oil-in-water microemulsions, whether as concentrates of after dilution with water, with the essential components thereof being detergent, water insoluble organic compound, co-surfactant and water.

Another useful sulfonated anionic surfactant is a linear sodium alkyl benzene sulfonate (LAS) which is characterized by the formula:

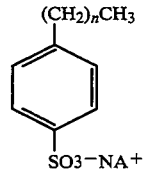

wherein n is from about 9 to about 15

The concentration of the paraffin or linear alkyl benzene sulphonate in the instant composition is about 5 to about 30 wt %, more preferably about 15 to about 30 wt % and the concentration of the alkyl ether sulphate is about 1 to about 20 wt %, more preferably about 2 to about 12 wt %.

Among the advantages of the present invention over previously known liquid detergent compositions are the following:

1. Liquid detergent compositions embodying the invention can be produced having comparably efficacy and properties with lower percentages of active ingredients and comparable clarity with significantly lower percentages of solubilizers than are disclosed in previously known compositions for the removal of grease deposits.

2. Compositions embodying the present invention can produce foam as good or better than that produced by prior art compositions, both in quantity and durability.

3. Compositions embodying the present invention, when diluted to the same concentration for use as the prior art compositions, can give substantially better performance as to grease removal, particularly in dishwashing.

4. Washing solutions made with compositions embodying the present invention have significantly lower surface tension than solutions of the same concentration using prior art compositions.

Additional advantages of the present invention are improved and controlled performance such as foaming and dishwashing ability, viscosity and clarity, which are important features in consumer acceptability.

The paraffin sulphonates (A) used in the compositions of the present invention are usually mixed secondary alkyl sulphonates having from 10 to 20 carbon atoms per molecule; preferably at least 80%, usually at least 90%, of the alkyl groups will have 13–17 carbon atoms per molecule. Where the major proportion has 14–15 carbon atoms per molecule, optimum foaming performance appears to be obtained at varying concentrations and water hardnesses. Another useful sulfonated anionic surfactant is a linear sodium alkul benzene sulfonate (LAS) which is characterized by the formula: wheren n is from about 9 to 15. The sulphonates are generally present in amounts from 15% to 60%, preferably 20% to 35%, by weight of the composition.

The higher alkyl ether sulphates (C) used in the compositions of the present invention are represented by the formula:

$$RO(C_2H_4O)_nSO_3X$$

in which R represents a primary or secondary alkyl group that may be straight or branched having from 10 to 18 carbon atoms, preferably from 12 to 15, X is a suitable water soluble cation, as hereinafter defined, and n is from 1 to 10, preferably from 1 to 6. These sulphates are produced by sulphating the corresponding ether alcohol and then neutralizing the resulting sulphuric acid ester.

The cation of the paraffin sulphonate (A) and the alkyl ether sulphate (C) may be an alkali metal (e.g. sodium or potassium), an alkaline earth metal (e.g. magnesium), ammonium or lower amine (including alkylolamines). It is preferred to use the sodium salt of the paraffin sulphonic acid and a sodium salt of the alkyl ether sulphuric acid ester oxide, dodecyl phenol condensed with 15 moles of ethylene oxide, and dinonyl phenol condensed with 15 moles of ethylene oxide. These aromatic compounds are not as desirable as the aliphatic alcohol ethoxylates in the invented compositions because they are not as biodegradable.

The water soluble or water dispersible nonionic synthetic organic detergents that are optionally employed in the composition at a concentration of 0 to 6 wt %, preferably 0.1 to 6 wt % in the invented cleaning compositions are usually condensation products of an organic aliphatic or alkylaromatic hydrophobic compound and ethylene oxide, which is hydrophilic. Almost any hydrophobic compound having a carboxy, hydroxy, amido or amino group with a free hydrogen present can be condensed with ethylene oxide or with polyethylene glycol to form a nonionic detergent. The length of the polyethenoxy chain of the condensation product can be adjusted to achieve the desired balance between the hydrophobic and hydrophilic elements (hydrophilic-lipophilic balance, or HLB) and such balances may be estimated as HLB numbers.

Particulary suitable nonionic detergents are the condensation products of a higher aliphatic alcohol, containing about 8 to 18 carbon atoms in a straight or branched chain configuration, condensed with about 2 to 30, preferably 2 to 10 moles of ethylene oxide. A 5 particularly preferred compound is $C_{9-11}$ alkanol ethoxylate of five ethylene oxides per mole (5 EO), which also may be designated as $C_{9-11}$ alcohol EO 5:1, $C_{12-15}$ alkanol ethoxylate (7 EO), or $C_{12-15}$ alcohol EO 7:1 is also preferred, such nonionic detergents are commercially available from Shell Chemical Co. under the trade names Dobanol 91-5 and Neodol 25-7.

Other suitable nonionic detergents are the polyethylene oxide condensates of one mole of alkyl phenol containing from about 6 to 12 carbon atoms in a straight or branched chain configuration, with about 2 to 30, preferably 2 to 15 moles of ethylene oxide, such as nonyl phenol condensed with 9 moles of ethylene oxide, dodecyl phenol condensed with 15 moles of ethylene oxide, and dinonyl phenol condensed with 15 moles of ethylene oxide. These aromatic compounds are not as desirable as the aliphatic alcohol ethoxylates in the invented compositions because they are not as biodegradable.

Another well-known group of usable nonionic detergents is marketed under the trade name "Pluronics." These compounds are block copolymers formed by condensing ethylene oxide with a hydrophobic base formed by the condensation of propylene oxide with propylene glycol. The molecular weight of the hydrophobic portion of the molecule is of the order of 950 to 4000, preferably 1200 to 2500. The condensation of ethylene oxide with the hydrophobic moiety increases the water solubility of the molecule. The molecular weight of these polymers is in the range of 1000 to 15,000, and the polyethylene oxide content may comprise 20 to 80% thereof.

Still other satisfactory nonionic detergents are a condensation of a $C_{10-16}$ alkanol with a heteric mixture of ethylene oxide and. propylene oxide. The mole ratio of ethylene oxide to propylene oxide is from 1:1 to 4:1, preferably from 1.5:1 to 3.0:1, with the total weight of the ethylene oxide and propylene oxide contents (including the terminal ethanol group or propanol group) being from 60% to 85%, preferably 70% to 80%, of the molecular weight of the nonionic detergent. Preferably the higher alkanol contains 12 to 15 carbon atoms and a preferred compound is the condensation product of $C_{13-15}$ alkanol with 4 moles of propylene oxide and 7 moles of ethylene oxide. Such preferred compounds are commercially available from BASF Company under the trade name Lutensol LF.

Also suitable for incorporation in the invented cleaning compositions are the nonionic detergents that are derived from the condensation of ethylene oxide with the product resulting from the reaction of propylene oxide and ethylene diamine. For example, satisfactory such compounds contain from about 40 to about; 80% of polyoxyethylene by weight, have a molecular weight of from about 5000 to 11,000, and result from the reaction of ethylene oxide with a hydrophobic base which is a reaction product of ethylene diamine and excess propylene oxide, and which is of a molecular weight in the range of 2500 to 3000.

Additionally, polar nonionic detergents may be substituted for the generally non-polar nonionic detergents described above. Among such polar detergents are those in which a hydrophilic group contains a semipolar bond directly between two atoms, for example N—O and P—O. There is charge separation between such directly bonded atoms, but the detergent molecule bears to net charge and does not dissociate into ions. Suitable such polar nonionic detergents include open chain aliphatic amine oxides of the general formula $R^7$-$R^8$-$R^9$N—O, wherein $R^7$ is an alkyl, alkenyl or monohydroxyalkyl radical having about 10 to 16 carbon atoms and $R^8$ and $R^9$ are each selected from the group consisting of methyl, ethyl, propyl, ethanol and propanol radicals. Preferred amine oxides are the $C_{10-16}$ alkyl dimethyl and dihydroxyethyl amine oxides, e.g. lauryl dimethyl amine oxide and lauryl myristyl dihydroxyethyl amine oxide. Other operable polar nonionic detergents are the related open chain aliphatic phosphine oxides having the general formula $R^{10}$-$R^{11}$-$R^{12}$P—O wherein $R^{10}$ is an alkyl, alkenyl or monohydroxyalkyl radical of a chain length in the range of 10 to 18 carbon atoms, and $R^{11}$ and $R^{12}$ are each alkyl or monohydroxyalkyl radicals containing from 1 to 3 carbon atoms. As with the amine oxides, the preferred phosphine oxides are the $C_{10-16}$ alkyl dimethyl and dihydroxyethyl phosphone oxides.

In dilute o/w microemulsion compositions of this invention, the nonionic detergent can be present in admixture with the anionic detergent. The proportion of nonionic detergent in such mixed detergent compositions, based on the final dilute o/w microemulsion composition, may be in the range of 0 to 6 wt %, preferably 0.1 to 6 wt %.

Many other suitable anionic and nonionic detergents that may be derisive components of the present microemulsion cleaning compositions are described in texts denoted to detergency, detergent compositions and components, including *Surface Active Agents (Their Chemistry and Technology)*, by Schwartz and Perry, and the various annual editions of John W. McCutcheon's *Detergents and Emulsifiers.*

The viscosity and clarity control system for the composition comprises a solublizing agent such as urea and a lower aliphatic alcohol which is a co-surfactant, and optionally a water soluble hydrotrope which is effective in promoting the compatibility of the ingredients in the microemulsion composition and can be substituted for part of the urea or alcohol. Generally, the viscosity and clarity control system is required in concentrated liquid detergent compositions containing at least 30 wt % by weight of active ingredients, namely the sum of paraffin sulphonate and alkyl ether sulphate.

Suitable hydrotropic substances are the alkali metal organic sulphonated (including sulphated) salts having an alkyl group up to 6 carbon atoms. The preferred sulphonated hydrotropes are alkyl aryl sulphonates having up to 3 carbon atoms in the alkyl group, e.g. the sodium and potassium xylene, toluene, ethylbenzene and isopropyl benzene (cumene) sulphonates. Sulphonates made from xylene include orthoxylene sulphonate, metaxylene sulphonate, paraxylene sulphonate and ethylbenzene sulphonate. Commercial xylene sulphonates usually contain metaxylene sulphonate as the main ingredient. Analysis of typical commercial xylene sulphonate products shows about 40 to 50% metaxylene sulphonate, 10 to 35% orthoxylene sulphonate and 15 to 30% paraxylene sulphonate with 0 to 20% ethylbenzene sulphonate. Any suitable isomeric mixture, however, may be employed. Sodium cumene sulphonate and sodium xylene sulphonate are preferred alkyl aryl sulphone hydrotropes for use in the compositions of the present invention. It is also permissible to use suitably alkyl sulphate salts having 5 or 6 carbon atoms in the alkyl group such as alkali metal n-amyl and n-hexylsulphates.

The use of the viscosity and clarity control system imparts superior low temperature clarity of the liquid detergent composition and provides control of the viscosity of the product over a wider range for any particular concentration of active ingredients, as will be set forth in greater detail hereinafter. The alcohols preferably have 2 or 3 carbon atoms. Thus, ethyl alcohol, propyl alcohol, isopropyl alcohol or propylene glycol can be used; preferably ethyl alcohol will be used.

The proportions of urea, alcohol and hydrotropic substance best suited for any particular composition depend on the active ingredient components and proportions and can be determined by the formulator by conventional tests. The weight content of this viscosity and control system based upon the total composition will vary from 0 to 22% and preferably is from 0.5 to 10%. Within that range solublizing will vary within the ranges of from 0 to 8.0%, preferably from 0.5 to 6%, and the cosurfactant will be from 0 to 14%, preferably 0.15 to 10%. The ratio of alcohol to urea is maintained below 1.3:1, preferably below 1:1 and most preferably is in the range from 0.37:1 to 0.85:1 when using an active ingredient content above 30% by weight, preferably 35 to 45%. Varying amounts of hydrotrope such a xylene sulphonate may be added or substituted in part for the alcohol or urea so as to form a ternary system with special properties such as markedly to increase the viscosity. The amount should be selected so as to maintain a satisfactory viscosity and cloud point and maintain other desirable properties. Generally, the hydrotrope may constitute up to 15% by weight of the total viscosity and control system.

The co-surfactant component plays an essential role in the concentrated and diluted microemulsions of this invention. In the absence of the co-surfactant the water, detergent(s) and water insoluble organic compound, when mixed in appropriate proportions, will form either a micellar solution, at lower concentrations, a microemulsion, or a conventional oil-in-water emulsion. With the presence of the co-surfactant in such systems in interfacial tension or surface tension at the interfaces between the lipophile droplets and the continuous aqueous phase is greatly reduced, to a value close to ($10^{-3}$ MN/m). This reduction of the interfacial tension results in spontaneous disintegration of the dispersed phase globules or droplets until they become so small that they cannot be perceived by the unaided human eye, and a clear microemulsion is formed, which appears to be transparent. In such microemulsion state thermodynamic factors come into balance, with varying degrees of stability being related to the total free energy of the microemulsion. Some of the thermodynamic factors involved in determining the total free energy of the system are (1) particle-particle potential; (2) interfacial tension or free energy (stretching and bending); (3) droplet dispersion entropy; and (4) chemical potential changes upon formation of the microemulsion. A thermodynamically stable system is achieved when interfacial tension or free energy is minimized and when droplet dispersion entropy is maximized. Thus, it appears that the role of the co-surfactant in formation of a stable o/w microemulsion is to decrease interfacial tension and to modify the microemulsion structure and increase the number of possible configurations. Also it seems likely that the co-surfactant helps to decrease rigidity of the dispersed phase with respect to the continuous phase and with respect to the oily and greasy soils to be removed from surfaces to be contacted by the microemulsions.

The amount of co-surfactant employed to stabilize the microemulsion compositions will depend on such factors as the surface tension characteristics of the co-surfactant, the types and proportions of the detergents and perfumes, and the types and proportions of any additional components which are present in the composition and which have an influence on the thermodynamic factors previously enumerated. Generally, amounts of co-surfactant in a preferred range of 0 to 14%, more preferably 0.15 to 10%, and especially preferred 1 to 8%, provide stable dilute o/w microemulsions for the above-described levels of primary surfactants, water insoluble organic compound, and any other additives as described below, in the diluted microemulsions. Related ranges for concentrated microemulsions are obtained by multiplying the extremes of the given ranges by five.

The water insoluble organic compound of the instant composition can be one or more water insoluble organic compounds which have a molecular weight of less than 250, more preferably less than 175 and is less than 1.0 wt. % soluble in water at room temperature which have an average $\delta_H$ (hydrogen bonding solubility parameter) of about 0 to about 12 $(MPa)^{\frac{1}{2}}$, an average $\delta_p$ (polar solubility parameter) of about 0 to about 6 $(MPa)^{\frac{1}{2}}$, and an average $\delta_d$ (dispersion solubility parameter) of about 14 to about 19 $(MPa^{\frac{1}{2}})$. When the water insoluble compound has these average solubility parameters, the microemulsion composition of the instant invention will exhibit maximum grease cleaning capacity for the removal of grease deposits of hard surface. The water insoluble organic compounds are selected from the group consisting essentially of D-limonene, Isopars sold by Exxon Chemical Co which are isoparaffenic hydrocarbons having 6 to 16 carbon atoms. Exxates such as Exxate 1000 and Exxate 1300 sold by Exxon Chemical Co., mixture of water insoluble aliphatic alcohols having about 6 to about 18 carbon atoms and an aliphatic or isoaliphatic hydrocarbons having about 8 to about 30 carbon atoms in a ratio of aliphatic or alcohols to aliphatic or isoaliphatic hydrocarbons of about 10:1 to about 1:10 mixtures of water insoluble aliphatic alcohols having about 6 to about 18 carbon atoms and water insoluble alkyl esters having about 10 to about 20 carbon atoms in a ratio of aliphatic alcohols to alkyl esters of about 10:1 to about 1:10. The concentration of the water insoluble organic compound is about 1 to about 20 wt %, more preferably about 2 to about 15 wt %.

The pHs of the final microemulsion, concentrated or diluted, will be dependent in large part on the identity of the co-surfactant compound, with the choice of the co-surfactant also being affected by cost and cosmetic properties, often particularly odor or fragrance. For example, microemulsion compositions which are to have a pH in the range of 1 to 10 may employ either an alkanol, propylene glycol, or ethylene glycol or propylene glycol ether or ester, or an alkyl phosphate as the sole co-surfactant but such pH range may be reduced to 1 to 8.5 when polyvalent metal salt is present.

In addition to their excellent capacity for cleaning greasy and oily soils, the low pH o/w microemulsion formulations of this invention also exhibit excellent other cleaning properties. They satisfactorily remove soap scum and lime scale from hard surfaces when applied in neat (undiluted) form, as well as when they are diluted. For such applications onto originally hard shiny surfaces having surface deposits of lime scale and/or soap scum, which may also be soiled with oily and greasy deposits, the microemulsions may be of a pH in the 0.5 to 6 range, preferably 1 to 4 and more preferably 1.5 to 3.5. For general cleaning of oily and greasy surfaces, without lime scale or soap scum deposits, the pH may be in the range of 1 to 11 and sometimes 6–11 or 6–8 will be preferred and more preferred, respectively (for mildness and effectiveness).

The final essential component of the invented microemulsions is water. Such water may be tap water, usually of less then 150 ppm hardness, as $CaCO_2$, but preferably will be deionized water or water of hardness less than 50 ppm, as $CaCO_3$. The proportion of water in the o/w microemulsion compositions generally is in the range of 15 to 85%.

The concentrated and dilute clear o/w microemulsion liquid all-purpose cleaning compositions of this invention are effective when used as is, without further dilution by water, but it should be understood that some dilution, without disrupting the microemulsion, is possible and often may be preferable, depending on the levels of surfactants, co-surfactants, water insoluble organic compounds, and other components present in the composition. For example, at preferred low levels of anionic dilutions up to about 50% will be without any phase separation (the microemulsion state will be maintained) and often much greater dilutions are operative. Even when diluted to a great extent, such as 2- to 10-fold or more, for example, the resulting compositions are often still effective in cleaning greasy, oily and other types of lipophilic soils.

It is within the scope of this invention to formulate various concentrated microemulsions which may be diluted with additional water before use.

The concentrated microemulsions, like other such emulsions previously mentioned, can be diluted by mixing with up to about 20 times or more, even sometimes to 100 times, but preferably about 3 or 4 to about 10 times their weight of water, e.g. 4 times, to form microemulsions similar to the diluted microemulsion compositions described above. While the degree of dilution is suitably chosen to yield a microemulsion composition after dilution, it should be recognized that during and at the ends of dilutions, especially when diluting from concentrated emulsions, microemulsion stages may be encountered.

Optionally, the o/w microemulsion compositions may include minor proportions, e.g. 0.1 to 5.0% preferably 0.25 to 4.0%, on a dilute product basis, of a $C_{8-22}$ fatty acid or fatty acid soap as a foam suppressant. The addition of free higher fatty acid or fatty acid soap provides an improvement in the rinsability of the composition, whether the microemulsion is applied in neat or diluted form. Generally, however, it is desirable to increase the level of co-surfactant, as to 1.1 to 1.5 times its otherwise normal concentration, to maintain product stability when the free fatty acid or soap is present.

Examples of the fatty acids which can be used as such or in the form of soaps, include distilled coconut oil fatty acids, "mixed vegetable" type fatty acids (e.g. those of high percentages of saturated, mono- and/or poly-unsaturated $C_{18}$ chains), oleic acid, stearic acid, palmitic acid, eicosanoic acid, and the like. Generally those fatty acids having from 8 to 22 carbon atoms therein are operative.

The composition can optionally contain 0 to about 5.0 wt % of an alkyloamide as a foam builder. Its presence results in a product which exhibits high foaming power in use, particularly in the stability of the foam generated during dishwashing or laundering operations. It should not be employed in an amount sufficient to impair the desired physical properties. The acyl radical of the alkylolamide is selected from the class of fatty acids having from 8 to 18 carbon atoms and each alkylol group usually has up to 3 carbon atoms. It is preferred to use the monoethanolamides of lauric and myristic acids but diethanolamides and isopropanolamides as well as monoethanolamides of fatty acids having from 10 to 14 carbon atoms in the acyl radical are satisfactory. Examples are capric, lauric and myristic and "heart cut" coconut ($C_{12}$–$C_{14}$) monoethanolamides, diethanolamides and isopropanolamides and mixtures thereof. There may be employed also the alkylolamides which are substituted by additional ethenoxy groups; suitable examples may be the above amides condensed with from 1 to 4 moles of ethylene oxide.

The protein optionally employed in the compositions of this invention is a water-soluble partially degraded protein and may be a partially enzymatically hydrolyzed protein or a heat derived product of protein. This material may be employed as an agent to overcome the irritant effect upon the skin of the surface active compounds. When the partially degraded protein is applied together with or subsequent to contact with the surface active compounds, the prophylactic effect is found to be present. The partially degraded protein is characterized as having a gel strength of about 0 to about 200 Bloom grams. The partially degraded protein may also provide rinse and drain properties to the composition. Such hydrolysis, such as by the action of trypsin, or pancreatic enzymes on protein material. The partially degraded protein may also be a heat derived decomposition product of protein. Proteins partially degraded by heat and having the required Bloom strength for use in the compositions may be prepared by heating proteinaceous material such as bones, feet or skin of pork or beef which has been reduced to small pieces and immersed in water, by autoclaving. A preferred hydrolyzed protein is a partially enzymatically hydrolyzed protein derived from beef collagen. Typical proteins which may be partially hydrolyzed for use in the compositions include casein, gelatin, collagen, albumin, zein, keratin, fibroin, globulin and glutenin. Typical commercial partially enzymatically hydrolyzed proteins include Bacto-Proteose, proteose-peptone, casein-peptone, gelatin-peptone, Bacto-peptone, vegetable peptones, such as soybeans peptone, the solubilized collagen being derived by heating bones, feet or skin of pork or beef. The preferred proteins are solubilized beef collagen and solubilized pork collagen. The partially hydrolyzed protein may have a relatively broad spectrum of molecular weights in the range from about 500 to about 70,000, preferably from about 500 to about 10,000 for hand care effects and from about 25,000 to about 70,000 for good drain properties. The lower molecular weight proteins may contain some completely degraded polypeptides, such as dipeptides and tripeptides and even some amino acids as a results of the degradation process. The protein, where employed, will generally be used in amounts in the range from 0.1 to 2.0% by weight, preferably from 0.3 to 0.8% by weight.

The liquid detergent compositions of the present invention may also contain any of the additives used in other liquid. detergent compositions such as sequestrants, e.g. salts of ethylenediamine tetraacetic acid, such as the sodium and potassium salts, and salts of hydroxy ethyl ethylene diamine triacetate. If it is desirable to tint or color the liquid detergent composition, any suitable dyes may be used for this purpose. Perfume may also be added to the compositions to give them a pleasant odor.

In the final diluted form, the all-purpose liquids are clear microemulsions and exhibit satisfactory stability at reduced and increased temperatures. More specifically, such compositions remain clear and stable in the range of 5° C. to 50° C., especially 10° C. to 43° C. They exhibit a pH in the acid, neutral or alkaline range, e.g. 1–11, depending on intended end use, with acidic and neutral pHs, e.g. 2 to 7 or 2 to 8 being preferred and with acidic pHs, e.g. 1–4 or 2–3.5 being considered best for lime scale and soap scum removal applications. The liquids are readily pourable and exhibit a viscosity in the range of 5 to 150 or 200 centipoises, preferably 6 to 60 centipoises (cps) and more preferably 10 to 40 cps, as measured at 25° C. with Brookfield RVT Viscometer, using a No. 1 spindle rotating at 20 rpm. Usually the product viscosity, in the absence of thickening agent, will be no greater than 100 cps even for the lower microemulsions.

The liquid compositions are preferably packaged in manually operated spray dispensing containers of synthetic organic polymeric plastic, e.g. PVC, polyethylene or polypropylene, which may include nylon closure, valve and nozzle parts, but they can also be packaged under pressure in aerosol containers. Such products, including the dispensers provided, are especially suitable for so-called spray-and-wipe applications but in the present operations wiping may be omitted and relatively little rinsing may be substituted for it.

Because the compositions, as prepared, are aqueous liquid formulations and because often no particular mixing procedure is required to be followed to cause formation of the desired microemulsions. The compositions are easily prepared, often simply by combining all of the components thereof in a suitable vessel or container. The order of mixing the ingredients in such cases is not particularly important and generally the various materials can be added sequentially or all at once or in the form of aqueous solutions or each or all of the primary detergents and co-surfactants can be separately prepared and combined with each other, followed by the water insoluble organic compound. However, to avoid any problems with the microemulsions breaking or not forming properly one may make a solution of the synthetic detergent(s) in water, dissolve the co-surfactant therein, and then admix in the water insoluble organic compound, which thus spontaneously forms the concentrated or dilute microemulsion, which operations are conducted at a temperature in the 5° to 50° C. range, preferably 10° to 43° C. and more preferably 20° to 30° C. If fatty acid is to be employed for its antifoaming effect, it will preferably be melted and added to the surfactant-co-surfactant solution, followed by the water insoluble organic compound. Dilute microemulsions can be made from the concentrated microemulsion by dilution with at least 50% thereof of water, with both the microemulsion and the water being in the described temperature range. The products resulting are of dispersed lipophilic phase droplet sizes in the range of 50 to 500Å, preferably 100 to 500Å, with the smaller particle sizes promoting better absorption of oily soils from soiled substrates to be cleaned.

The microemulsion composition can be used as a prespotter which comprises 5 to 12 wt % of a paraffin sulphonate; 1 to 4 wt % of an alkyl ether sulphate; 35 to 65 wt % of 2-limonene; 15 to 25 wt % of butylcarbitol; and the balance being water.

DETAILED DESCRIPTION OF THE PREFERRED EMBODIMENT

The following examples illustrate liquid cleaning compositions of the present invention. Unless otherwise specified, all percentages and parts given in these examples, this specification and the appended claims are by weight and all temperatures are in ° C. The exemplified compositions are illustrative only and do not limit the scope of the invention.

EXAMPLE 1

The following examples were prepared at room temperature by dissolving the anionic and/or nonionic surfactants in the water, then dissolving the urea and then the alcohol solvents followed by admixing in the D-limonene, Isopar H, Exxate 1000, Exxate 1300, isooctanol, decane and/or $C_{13}$ acetate into the water solution to form a stable homogenous o/w microemulsion. The formulas were tested for appearance, olive oil uptake, miniplates and volume of foam in ml at the start and end. The examples and test results are as follows:

| | A | B | C | D | E | F | G | H | I | J | K | L |
|---|---|---|---|---|---|---|---|---|---|---|---|---|
| Paraffin sulphonate | 25.5 | 25.5 | 25.5 | 25.5 | 25.5 | 25.5 | 25.5 | 25.5 | 25.5 | 25.5 | 25.5 | 25.5 |
| Sodium salt $C_{12-14}$ ether sulphate | 8.5 | 8.5 | 8.5 | 8.5 | 8.5 | 8.5 | 8.5 | 8.5 | 8.5 | 8.5 | 8.5 | 8.5 |
| D-Limonene | 6.0 | 6.0 | 6.0 | 6.0 | — | — | — | 2.0 | 4.0 | 6.0 | 8.0 | 9.0 |
| Ethanol | 4.0 | 4.0 | 4.0 | 4.0 | 4.0 | 4.0 | 4.0 | 4.0 | 4.0 | 4.0 | 4.0 | 4.0 |
| Urea is | 5.0 | 5.0 | 5.0 | 5.0 | 5.0 | 5.0 | 5.0 | 5.0 | 5.0 | 5.0 | 5.0 | 5.0 |
| Isopropanol | 3.0 | 3.0 | — | 3.0 | 3.0 | 3.0 | 3.0 | 3.0 | 3.0 | 3.0 | 3.0 | 3.0 |
| Propylene glycol | — | 3.0 | — | — | — | — | — | | | | | |
| Butyl carbitol | — | — | 3.0 | — | — | — | — | | | | | |
| Ethylene glycol mono butyl ether | — | — | — | 3.0 | — | — | — | | | | | |
| Isopar H | — | — | — | — | 2.0 | — | — | — | — | — | — | — |
| Exxate 1300 | — | — | — | — | — | 2.0 | — | | | | | |
| Exxate 1000 | — | — | — | — | — | — | 4.0 | | | | | |
| Water | Bal | Bal | Bal | Bal | Bal | Bal | Bal | Bal | Bal | Bal | Bal | Bal |
| Appearance | Clear | Clear | Clear | Clear | Clear | Clear | Clear | Clear | Clear | Clear | Clear | Turb |
| Olive oil uptake | | | | | 1.5 | 1.2 | 1.8 | 1.3 | 3.0 | 3.5 | 4.4 | — |
| Miniplate | | | | | — | 43 | 46 | — | 46 | 45 | — | — |
| Foam start (ml) | | | | | — | — | 100 | — | 75 | 75 | — | — |
| Foam end (ml) | | | | | — | — | 250 | — | 250 | 240 | — | — |
| Gardner dilute | | | | | | | 24 | | 27 | 13 | | |

| | M | N | O | P | Q | R | S | T | U | V | W | X |
|---|---|---|---|---|---|---|---|---|---|---|---|---|
| Paraffin sulphonate (LAS) | 25.5 | 25.5 | 25.5 | 25.5 | 25.5 | 25.5 | 25.5 | 25.5 | 25.5 | 25.5 | 25.5 | 25.5 |
| Sodium salt $C_{12-14}$ ether sulphate | 8.5 | 8.5 | 8.5 | 8.5 | 8.5 | 8.5 | 8.5 | 8.5 | 8.5 | 8.5 | 8.5 | 8.5 |
| D-Limonene | — | — | — | | | | | | | | | |
| Ethanol | 4.0 | 4.0 | 4.0 | 4.0 | 4.0 | 4.0 | 4.0 | 4.0 | 4.0 | 4.0 | 4.0 | 4.0 |
| Urea | 6.0 | 6.0 | 6.0 | 6.0 | 6.0 | 6.0 | 6.0 | 6.0 | 6.0 | 6.0 | 6.0 | 6.0 |
| Isopropanol | 3.0 | 3.0 | 3.0 | 3.0 | 3.0 | 3.0 | 3.0 | 3.0 | 3.0 | 3.0 | 3.0 | 3.0 |
| Propylene glycol | | | | | | | | | | | | |
| Butyl carbitol | | | | | | | | | | | | |
| Ethylene glycol mono butyl ether | | | | | | | | | | | | |
| Isopar H | 4.0 | 6.0 | 8.0 | — | — | — | — | — | — | 2.4 | 4.8 | 3.6 |
| Exxate 1300 | | | | 2.0 | 4.0 | 6.0 | 8.0 | — | — | 3.0 | 1.2 | 2.4 |
| Exxate 1000 | | | | — | — | — | — | 4.0 | 6.0 | | | |
| Water | Bal | Bal | Bal | Bal | Bal | Bal | Bal | Bal | Bal | Bal | Bal | Bal |
| Appearance | Clear | Clear | Clear | Clear | Clear | Turb | Turb | Clear | Turb | Clear | Clear | Clear |
| Olive oil uptake | 2.1 | 3.0 | 3.5 | 1.2 | 1.8 | — | — | 1.8 | — | 4.0 | 5.0 | 4.0 |
| Miniplate | 34 | 26 | — | — | 43 | — | — | 46 | — | 4.3— | 29 | 36 |
| Foam start (ml) | 60 | 60 | — | — | 75 | — | — | 100 | — | 80 | 65 | 70 |
| Foam end (ml) | 110 | 115 | — | — | 210 | — | — | 250 | — | 250 | 105 | 130 |
| Gardner dilute | >150 | >150 | | | >150 | | | 24 | | >150 | >150 | >150 |

| | AA | BB | CC | DD | EE | FF | GG | HH | II | JJ | KK | LL |
|---|---|---|---|---|---|---|---|---|---|---|---|---|
| Paraffin sulphonate | | 25.5 | 25.5 | 25.5 | 25.5 | 25.5 | 25.5 | 25.5 | 25.5 | 25.5 | 25.5 | 25.5 |
| Sodium salt $C_{12-14}$ ether sulphate | | 8.5 | 8.5 | 8.5 | 6.8 | 8.5 | 8.5 | 8.5 | 8.5 | 8.5 | 8.5 | 8.5 |
| D-Limonene | | — | — | — | 6.0 | 6.0 | | | | | | |
| Ethanol | | 4.0 | 4.0 | 4.0 | 4.0 | 4.0 | 4.0 | 4.0 | 4.0 | 4.0 | 4.0 | 4.0 |
| Urea | | 5.0 | 5.0 | 5.0 | 5.0 | 5.0 | 5.0 | 5.0 | 5.0 | 5.0 | 5.0 | 5.0 |
| Isopropanol | | 3.0 | 3.0 | 3.0 | 3.0 | 3.0 | 3.0 | 3.0 | 3.0 | 3.0 | 3.0 | 3.0 |
| Propylene glycol | | | | | | | | | | | | |
| Butyl carbitol | | | | | | | | | | | | |
| Ethylene glycol mono butyl ether | | | | | | | | | | | | |
| Isopar H | 2.4 | 1.2 | 2.4 | 3.6 | — | — | | | 3.2 | 2.4 | 1.6 | 0.8 |
| Exxate 1300 | 3.6 | | | | | | | | | | | |
| Exxate 1000 | | 4.8 | 3.0 | 2.4 | — | — | | | 0.8 | 1.6 | 2.4 | 3.2 |
| Water | Bal | Bal | Bal | Bal | Bal | Bal | Bal | Bal | Bal | Bal | Bal | Bal |
| Appearance | Clear | Clear | Clear | Clear | | | | | | | | |
| Olive oil uptake | 4.0 | 3.5 | 4.3 | 3.4 | | | | | 2.2 | 2.7 | 1.8 | 1.7 |
| Miniplate | 33 | 32 | 40 | 38 | | | | | 33 | 33 | 38 | 39 |
| Foam start (ml) | 80 | 75 | 75 | 90 | | | | | 75 | 90 | 90 | 73 |
| Foam end (ml) | 150 | 150 | 210 | 270 | | | | | 200 | 240 | 240 | 210 |
| Gardner dilute | >150 | >150 | >100 | >100 | | | | | 65 | 40 | 45 | 30 |

| | MM | NN | OO | PP | QQ | RR | SS | TT | UU |
|---|---|---|---|---|---|---|---|---|---|
| Paraffin sulphonate (LAS) | 25.5 | 25.5 | 25.5 | 25.5 | 25.5 | 25.5 | 25.5 | 25.5 | 25.5 |
| Sodium salt $C_{12-14}$ ether sulphate | 8.5 | 8.5 | 8.5 | 8.5 | 8.5 | 8.5 | 8.5 | 8.5 | 8.5 |

-continued

| | | | | | | | | | |
|---|---|---|---|---|---|---|---|---|---|
| D-Limonene | | | | | | | | | |
| Ethanol | 4.0 | 4.0 | 4.0 | 4.0 | 4.0 | 4.0 | 4.0 | 4.0 | 4.0 |
| Urea | 5.0 | 5.0 | 5.0 | 5.0 | 5.0 | 5.0 | 5.0 | 5.0 | 5.0 |
| Isopropanol | | | | | | | | | |
| Propylene glycol | | | | | | | | | |
| Butyl carbitol | | | | | | | | | |
| Ethylene glycol mono butyl ether | | | | | | | | | |
| Isopar H | 3.2 | 2.4 | 1.6 | 0.8 | | 3.2 | 2.4 | 1.6 | 0.8 |
| Exxate 700 | 0.8 | 1.6 | 2.4 | 3.2 | | | | | |
| Exxate 1300 | | | | | 4 | 0.8 | 1.6 | 2.4 | 3.2 |
| Water | Bal | Bal | Bal | Bal | Bal | Bal | Bal | Bal | Bal |
| Appearance | | | | | | | | | |
| Olive oil uptake | 2.1 | 1.9 | 1.9 | 1.7 | 1.5 | 2.5 | 2.3 | 1.9 | 2.3 |
| Miniplate | 35 | 36 | 38 | 39 | 42 | 32 | 35 | 36 | 35 |
| Foam start (ml) | 83 | 100 | 100 | 90 | 98 | 78 | 83 | 75 | 78 |
| Foam end (ml) | 195 | 225 | 265 | 255 | 216 | 165 | 175 | 190 | 180 |
| Gardner dilute | >100 | 45 | 30 | 25 | 15 | >150 | 65 | 70 | >150 |

The test procedures are as follows:

FOAM LONGEVITY - MINIPLATE TEST

A) Foam Longevity - Miniplate Test

Principle

The test aims at assessing the Foam Stability of a LDLD solution in presence of a fatty soil.

SOIL

Vegetable shortening: Crisco (from us)

This fat is injected in the LDLD solution with a Syringe at a flow rate of 0.6 G/MIN.

Product Concentration

10 ML of a 5% LDLD Solution are added to 400 ML of water (+1.25 GR/L of LDLD)

Test Procedure

During 1 minute foam is generated with a brush (according a hypocycloidal pattern). The brush keeps moving to help fat emulsification. Fatty soil is then injected in the solution at a constant flow rate up to disappearance of the foam. Foam generation and disappearance are evaluated by photo electrical cell and recorded automatically.

Results

Miniplate number: $MP=(GC \times GF \times \Delta T)/0.12$

GC=Grease Coefficient

GF=Grease flow equal to (Total injected grease weight) (T2-T0)

$\delta T$=Time measured from the beginning of grease injection (T0) and the end of foam detection (T1)

0.12=Correlation coefficient to relate the calculated miniplate number to the number of dishes washed by hand in similar conditions T2=End of test, grease injection is stopped Extrapolation Actual plate number can be easily extrapolated from miniplate number by assuming that each large plate is soild with 3 GR of fat.

(Number of miniplates)×(weight of product)×0.08

B) Foam Test - Foam Volume

Principle

Produce foam by rotation of a graduated cylinder containing a detergent solution.

This method allows to define the speed of foam generation and the maximum foam height generated in presence of fat.

Soil

Corn oil

Product Concentration 0.75 G/L Detergent solutiohn

Procedure 2 different products (including a reference) are simultaneously evaluated. 100 ML of a solution at 0.75 G/L of detergent at 47° C. is poured in a graduated cylinder.

1 Gr of corn oil is added to the solution.

The graduated cylinders are attached to the rotation assembly and allowed to turn 5 complete revolutions.

Foam height is recorded on the cylinder graduation.

The 5 complete revolutions are repeated 10 times. (Foam height is recorded after each 5 complete revolutions).

Results

Start foam volume (ML)

End Foam volume (ML)

C) Dynamic Degreasing

Principle

Cleaning power under mechanical action of a LDLD in neat and diluted conditions.

Soil

Neat: A solution at 10% of fat (Beef tallow and hardened tallow) in chloroform (colored with dye for fat)

Diluted: A solution at 1% of fat (Beef tallow and hardened tallow) In chloroform (colored with dye for fat)

Soiling Procedure

The soil solution is uniformly sprayed on white formica tile.

Evaluation Procedure

2 Products are simultaneously evaluated.

Neat: 4 Gr of Product are put on the sponge.

Diluted: 10 Gr of a 1.2% LDLD solution per sponge.

The soiled tiles and the sponges are introduced in the carriers of The Gardner Machine.

The Machine operates until 95% of the soil is removed.

Results

Expressed in number of storkes (back and forth) needed to remove 95% of the soil.

D) Olive Oil Uptake

Principle

Oil uptake of a dish liquid

Soil

Olive Oil

Product Concentration

Product as is

Procedure

In 50 ML of neat product start to add drops of olive oil. After each drop addition let the solution become clear again under agitation with a magenetic stirrer. If after 5 minutes, the solution is not clear, stop the addition of olive oil and record the amount of olive oil added.

Results

G of olive oil to reach saturation of 100 ML of product.

What is claimed is:

1. A composition comprising approximately by weight:

(a) 6 to 50% of a mixture of two different anionic surfactants, one of said anionic surfactants being a paraffin sulphonate and the other said anionic surfactant being an alkyl ether sulfate, a ratio of said sulphonate to said sulfate being 3.3:1 to 2:7;

(b) 0 to 6% of a nonionic surfactant;

(c) 1 to 20% of at least one of a water insoluble organic compound which has a $\delta p$ of about 0 to about 6 12 $(MPa)^{\frac{1}{2}}$, a $\delta H$ of about 0 to about 12 $(MPa)^{\frac{1}{2}}$, and a $\delta d$ of about 14 to about 19;

(d) 0 to 8% of a solubilizing agent;

(e) 0.15 to 10 % of at least one water soluble hydroxy containing organic compound; and (f) the balance being water, wherein the composition has a pH of about 1 to about 11 and is optically clear having at least 90% light transmission and the interfacial tension between the lipophile droplets of said composition and the aqueous phase being less than about $10^{-2}$ mN/m.

2. The composition of claim 1, wherein the sulfonate is a paraffin sulphonate and the sulfate is an alkyl ether sulfate and the ratio of said sulphonate to said sulphate is about 4:1 to 2:1.

3. The composition of claim 2, wherein said water insoluble organic compound has a ap of about 0 to about 6 12 $(MPa)^{\frac{1}{2}}$, a $\delta H$ of about 0 to about 12 $(MPa)^{\frac{1}{2}}$, and a $\delta d$ of about 14 to about 19.

4. The composition of claim 1, wherein said water insoluble organic compound is selected from the group consisting of D-limonene; mixture of water insoluble aliphatic alcohols having about 6 to about 18 carbon atoms and aliphatic and isoaliphatic hydrocarbons having about 8 to about 30 carbon atoms; mixtures of said water insoluble aliphatic alcohols having about 6 to about 18 carbon atoms and alkyl esters having about 10 to about 20 carbon atoms; and alephatic or isoaliphatic hydrocarbon having about 6 to 18 carbon atoms and mixtures thereof.

5. The composition of claim 1, wherein said water soluble hydroxy organic compound has about 2 to about 4 carbon atoms.

6. The composition of claim 5, wherein said water soluble hydroxy organic compound is selected from the group consisting of ethanol, propanol, isopropanol, and propylene glycol and mixtures thereof.

7. The composition of claim 6, wherein said water insoluble organic compound is D-limonene.

8. The composition of claim 1, wherein said solubilizing agent is urea.

9. The composition according to claim 1, wherein said composition is a microemulsion.

10. The composition of claim 1, further including a partially degraded protein.

11. The composition of claim 8, further including a hydrotrope which is an aryl sulphonate.

12. The composition of claim 1, wherein the concentration of the nonionic surfactant is about 0.1 to about 6.0 wt %.

13. The composition of claim 1, further including an alkylolamide.

14. The composition of claim 1, further including a sequestrant.

* * * * *